US005183257A

United States Patent [19]

Shore

[11] Patent Number: 5,183,257

[45] Date of Patent: Feb. 2, 1993

[54] FIRE SAFETY AND HAZARDS GAME

[76] Inventor: Kirstina D. Shore, 1117 N. Ridge Dr., Yuba City, Calif. 95991

[21] Appl. No.: 805,893

[22] Filed: Dec. 12, 1991

[51] Int. Cl.[5] ..... A63F 3/00

[52] U.S. Cl. ..... 273/243

[58] Field of Search ..... 273/243, 248, 249

[56] References Cited

U.S. PATENT DOCUMENTS

| | | | |
|---|---|---|---|
| 4,003,577 | 1/1977 | Bolach | 273/243 |
| 4,013,294 | 3/1977 | Smeda et al. | 273/243 X |
| 4,049,274 | 9/1977 | Jevons | 273/246 |
| 4,065,131 | 12/1977 | Martin, Jr. et al. | 273/243 |
| 4,730,831 | 3/1988 | De Sio | 273/243 |
| 4,993,717 | 2/1991 | Fiske | 273/243 |
| 5,042,816 | 8/1991 | Davis et al. | 273/243 |
| 5,064,200 | 11/1991 | Martinez | 273/243 |

*Primary Examiner*—V. Millin
*Assistant Examiner*—William E. Stoll
*Attorney, Agent, or Firm*—H. Jay Spiegel

[57] ABSTRACT

A board game is disclosed which is intended to promote fire safety among children. The players choose tokens made to resemble fire trucks and the tokens travel counterclockwise about a closed path responsive to throwing of dice. A short cut path poses special dangers for the players. As the tokens traverse the closed path, penalties are paid and awards and money are won with the player having the most awards and money at the end of the game being declared the winner.

7 Claims, 2 Drawing Sheets

FIG. 2
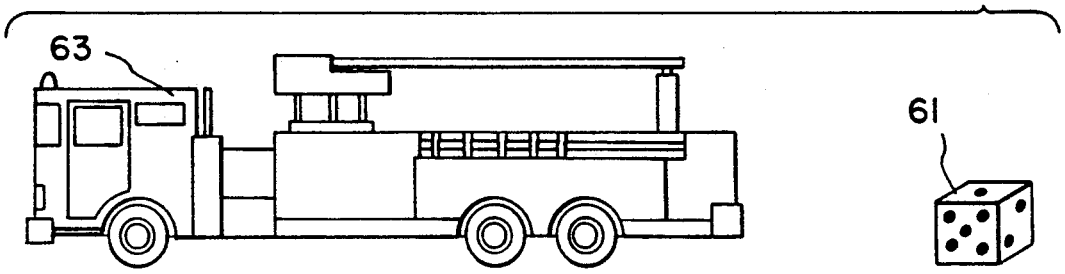
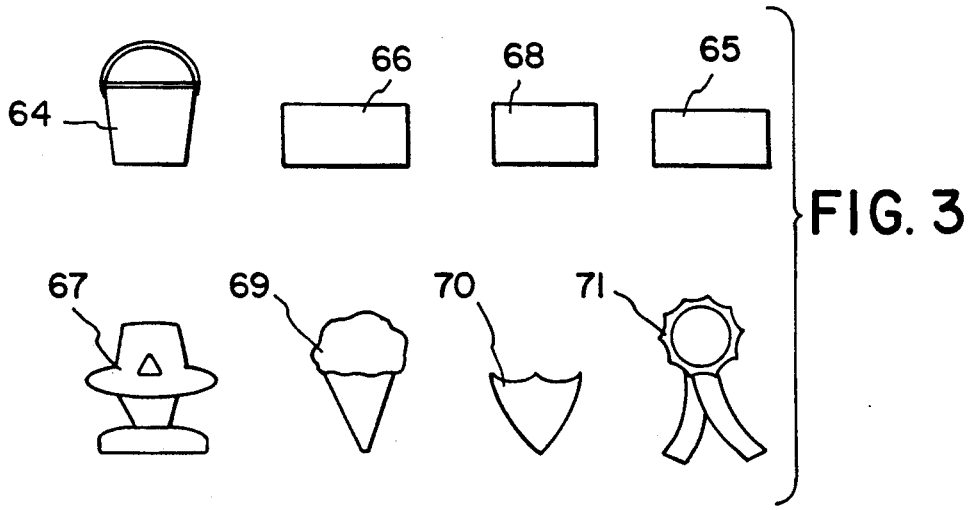
FIG. 3

FIRE SAFETY AND HAZARDS GAME

BACKGROUND OF THE INVENTION

The present invention relates to the Fire! Fire! board game. In the prior art, board games having educational themes are known. However, Applicant is unaware of any board game having the specific theme combined with the manner of play of the present invention.

Applicant is aware of U.S. Pat. 4,214,755 to Wysocki and U.S. Pat. 4,368,889 to Reker, Jr. Each of these patents teaches a board game having an educational theme. Wysocki teaches the use of an environmental theme in a board game while Reker, Jr. teaches a game wherein school experiences are simulated. The present invention is believed to be distinct from the teachings of these patents as including the specific theme of promotion of fire safety among children.

SUMMARY OF THE INVENTION

The present invention relates to the Fire! Fire! board game. The present invention includes the following interrelated objects, aspects and features:

(a) In a first aspect, the inventive game is played on a board having a closed path printed thereon. The closed path includes a start space which is accessed from a firehouse where the players begin play.

(b) The closed path has a first outer path and a short-cut path which allows a player to shorten the distance which must be travelled. However, dangers await any player who attempts to take the short-cut path.

(c) Each player chooses a token made in the likeness of a fire truck. The various spaces on the closed path include spaces where players win money and awards and where players are penalized for failing to observe requirements of fire safety.

(d) The object of the game is for players to travel about the closed path twice and arrive at the firehouse. When all players have arrived at the firehouse after traversing the closed path twice, the player with the largest number of awards and money is declared the winner.

Accordingly, it is a first object of the present invention to provide a Fire! Fire! board game.

It is a further object of the present invention to provide such a game wherein players traverse a closed path having spaces promoting the education of children concerning fire safety.

It is a yet further object of the present invention to provide such a game wherein players may win prizes and money or may be penalized and lose ground depending upon which spaces are landed upon.

These and other objects, aspects and features of the present invention will be better understood from the following detailed description of the preferred embodiment when read in conjunction with the appended drawing figures.

BRIEF DESCRIPTION OF THE DRAWINGS

FIG. 2 shows the game tokens and chance device used in playing the game.

FIG. 3 shows schematic representations of prizes and money which may be won by the players during the playing of the game.

SPECIFIC DESCRIPTION OF THE PREFERRED EMBODIMENT

Figure 1:
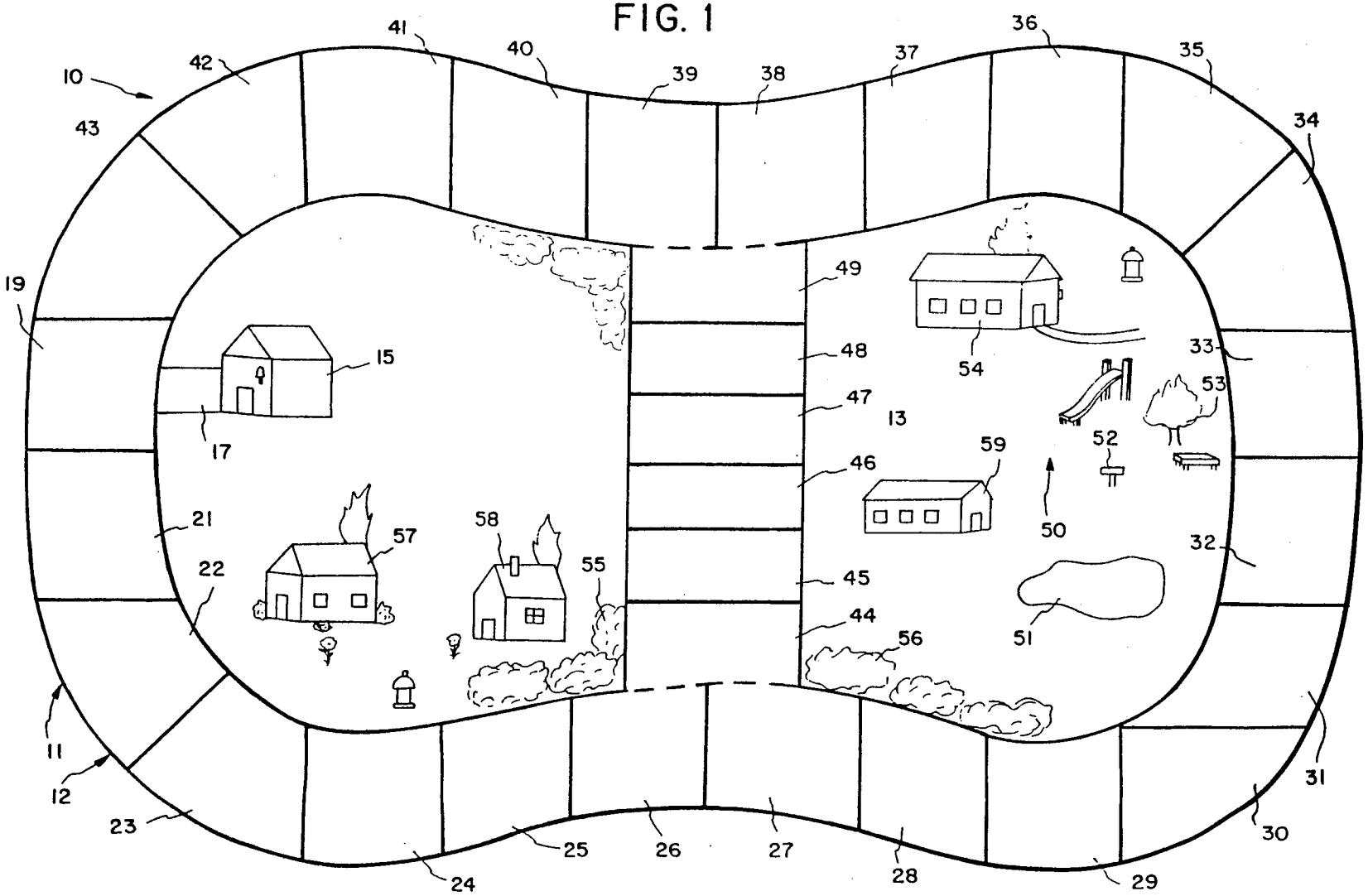
FIG. 1 shows a top view of the inventive game board.

With reference, first, to FIG. 1, the inventive board which is used in playing the inventive game is generally designated by the reference numeral 10 and is seen to include a closed path 11 having an outer path 12 as well as a short cut path 13 which is termed the "danger alley". The path 11 includes a firehouse 15 where players begin play and a space 17 leading to a start space 19. In the playing of the game, rolling of a "1" on the die takes a players token from the firehouse 15 to the start space 19.

In the playing of the game, players traverse the outer path 12 in a counterclockwise direction. Going counterclockwise around the outer path 12, the spaces have the following reference numeral designations and printing: t,40

In the short cut path termed "danger alley" 5 spaces are included as following:

| Reference Numeral | Printing in Space |
|---|---|
| 44 | "Miss 1 turn for playing with cigarettes." |
| 45 | "Go back to start for playing with the barbecue fire while Dad wasn't looking." |
| 46 | "Danger Alley Cafe: have a soda." |
| 47 | "Shame on you for trying to light a fire in the fireplace. Go back to start." |
| 48 | "You let the puppy chew on the electrical cord. Roll 5 or 6 to move again." |
| 49 | "You left the stove on while watching T.V. Go back to start." |

As should be understood, there is only one safe space in the danger alley 13 and that is the space 46. Thus, a player is taking an extreme risk to attempt to use the danger alley 13 as a short cut.

The board also includes a park 50, a pond 51, a barbecue 52, a tree 53, a school 54, bushes 55, 56, and other buildings 57, 58 and 59. These aspects of the board are mainly aesthetic and are referred to when players land on various spaces on the board.

FIG. 2 shows the chance device which is preferably employed in playing the game which consists of a die 61. Of course, any chance device may suitably be employed in the playing of the game. Furthermore, FIG. 2 depicts a token 63 which is made to resemble a hook and ladder fire truck. In the preferred embodiment of the present invention, four such tokens are provided in the colors red, blue, green and yellow.

FIG. 3 shows various of the prizes and awards which may be won and/or lost during the playing of the game. Thus, FIG. 3 schematically depicts a bucket 64, a CPR certificate 65, a $100 bill 66, a Child of the Year award 67, a free movie pass 68, an ice cream cone 69, a Junior Fire Department badge 70 and a Good Citizen award 71. As should be understood from the description above of the various spaces on the board, the items depicted in FIG. 3 are won and lost during the playing of the game.

Having described the inventive game board and the player tokens, chance device and various awards, the rules as to how the game is intended to be played will now be described. At the beginning of the game, each player chooses a fire truck token 63 of desired color. The players all roll the die 61 to determine the order of play. For example, order of play will be determined in descending order from the highest number rolled to the lowest. Of course, any other procedure may suitably be employed.

After the order of play has been determined, the players take their turns with each player being required to roll either 1 or 5 to leave the firehouse 15 and move to the start space 19. Thus, if a 1 is rolled, a player may move from the firehouse 15 to the start space 19. If a player rolls a 5, that player may move to the start space and then counterclockwise 4 spaces. If a 5 is rolled, a player will land on the space 24 and will win $100 to begin the game.

All players move their tokens 63 counterclockwise with players moving past the start space 19 once and then finishing at the firehouse 15 after a second lap around the path 11. In order to finish play, a player must land in the firehouse 15 with the exact roll on the die 61 necessary to precisely arrive there. Thus, for example, if in the second to the last turn, a player has landed on the start space 19, that player must roll a 1 on the die 61 to enter the firehouse 15 and complete their play.

As described above, a player may attempt to shorten the path which they may take by travelling through the danger alley 13. However, since the only safe space in the danger alley is the space 46, a player is taking an extreme risk of being made to either go back to start and begin that lap again, miss a turn, or be required to roll a particular number on the die before continuing play.

If a player lands on a space which requires that player to give up a particular award and that player does not have that particular award in their possession, the player may either lose one turn or forfeit another of the prizes that that player has in their possession.

After all players have successfully traversed the closed path 11 twice and have entered the firehouse 15, the player who has the most prizes depicted in FIG. 3 is designated the winner. In this regard, it should be understood that each of the separate prizes including the $100 bill 66 which are illustrated in FIG. 3 have equal weight with other prizes. Thus, for example, a player who ends the game having won four of the prizes or money illustrated in FIG. 3 will be declared the winner over any player who has three such prizes or money.

In the playing of the game, children learn about dangerous activities which can result in fire hazards, death and injury. Applicant intends that, through playing the game, fire safety will be strongly promoted and players will become aware of the dangers of fire and how to avoid them.

As such, an invention has been described in terms of a preferred embodiment thereof, which fulfills each and every one of the objects of the invention as set forth hereinabove and provides new useful Fire! Fire! board game of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. An improved board game for promoting safety, comprising:

a) a board having a closed path including a first circumferential path including two opposed outwardly curved sections interconnected with two opposed inwardly curved sections and a second short-cut path interconnected between said inwardly curved sections;

b) said first path having a multiplicity of spaces having printing thereon related t fire safety issues, at least one further space having printing thereon related to cardio-pulmonary resuscitation and a single space which, when landed upon, allows optional access to said second path;

c) said second path, when travelled, causing a player token to travel a shortened distance in travelling one lap about said closed path, said second path having a multiplicity of spaces including a plurality of spaces which, when landed upon, result in negative consequences and a single space which, when landed upon, results in no negative consequences;

d) a plurality of simulated awards, including awards for good citizenship and child of the year and a plurality of prizes including money, ice cream and a fire bucket, and spaces on said first path which, when landed upon, result in winning a prize or award;

e) further spaces on said first path which, when landed upon, result in losing a prize or award;

f) a space resembling a firehouse and connected to but separate from said first path;

g) a chance device which is used on each turn to control play;

h) whereby players take turns operating said change device and traversing said board, said players starting play on said space resembling a firehouse and being required to have a particular number displayed on said change device before being permitted to enter and transverse said first path, winning and losing prizes and awards and learning about fire safety, with the winner being that player who has retained the largest combined total of prizes and awards after transversing said closed path a particular chosen number of times.

2. The invention of claim 1, wherein said plurality of spaces in said second path include at least one space which, when landed upon, requires a player to go back to a start space on said first path.

3. The invention of claim 1, wherein said player token comprises a simulated fire truck.

4. The invention of claim 1, wherein said first path and second path each have a space which, when landed upon, requires a particular number to be displayed by said chance device before proceeding further.

5. The invention of claim 1, further including a start space on said first path connected to said space resembling a firehouse where play commences.

6. The invention of claim 1, wherein said first path has a space which, when landed upon, requires a player to travel said second path.

7. The invention of claim 1 wherein said chance device comprises a die.

* * * * *